US006755135B2

(12) United States Patent
Johnsen et al.

(10) Patent No.: US 6,755,135 B2
(45) Date of Patent: Jun. 29, 2004

(54) COMBINED TIE EXTRACTOR AND PLATE REMOVER FOR RAIL MAINTENANCE

(75) Inventors: David Sean Johnsen, Wauwatosa, WI (US); William D. Straub, Milwaukee, WI (US); Bruce M. Boczkiewicz, Mukwonago, WI (US)

(73) Assignee: Nordco Inc., Milwaukee, WI (US)

( * ) Notice: Subject to any disclaimer, the term of this patent is extended or adjusted under 35 U.S.C. 154(b) by 0 days.

(21) Appl. No.: 10/233,922

(22) Filed: Sep. 3, 2002

(65) Prior Publication Data

US 2003/0005850 A1 Jan. 9, 2003

Related U.S. Application Data

(63) Continuation-in-part of application No. 09/810,975, filed on Mar. 16, 2001, now Pat. No. 6,463,858, and a continuation-in-part of application No. 10/113,585, filed on Mar. 29, 2002.

(51) Int. Cl.[7] ..... E01B 29/06

(52) U.S. Cl. ..... 104/9; 104/6

(58) Field of Search ..... 104/2, 9, 6, 17.1, 104/12, 16, 7.1, 4; 198/836.1, 779; 254/131; 294/106, 902, 55.5

(56) References Cited

U.S. PATENT DOCUMENTS 3,881,422 A * 5/1975 Bryan, Jr. ..... 104/9
4,211,170 A * 7/1980 Theurer ..... 104/2
4,393,784 A * 7/1983 Theurer ..... 104/2
4,418,625 A 12/1983 Allmer
4,770,103 A * 9/1988 Allmer ..... 104/7.1
4,809,614 A * 3/1989 Theurer et al. ..... 104/7.2
4,872,646 A 10/1989 Siano
4,951,573 A 8/1990 Madison et al.
5,025,733 A 6/1991 Pierobon
5,048,424 A 9/1991 Madison et al.
5,063,856 A * 11/1991 Theurer et al. ..... 104/9
5,119,723 A 6/1992 Lovitt, Jr.
5,197,389 A 3/1993 Glomski et al.
5,305,692 A 4/1994 Madison
5,617,795 A 4/1997 Glomski et al.
5,651,317 A * 7/1997 Kim ..... 104/9
5,722,325 A * 3/1998 Glomski et al. ..... 104/9
6,158,353 A 12/2000 Theurer

* cited by examiner

*Primary Examiner*—Frantz F. Jules
(74) *Attorney, Agent, or Firm*—Greer, Burns & Crain, Ltd.

(57) ABSTRACT

A combined tie extractor and plate remover for railroad track maintenance includes a frame configured for movement along the track and having a first side corresponding to a first side of the track and a second side corresponding to a second side of the track, each side of the track having a corresponding rail. A rail lifting apparatus associated with the frame is configured for lifting a selected one of the first and second rails away from the track. A plate remover assembly associated with the frame is configured for grasping and removing tie plates associated with each side of the track from a selected tie. At least one tie extracting assembly is disposed on the frame for extracting the gripped tie transversely relative to the track in conjunction with the removal of the tie plates.

20 Claims, 6 Drawing Sheets

COMBINED TIE EXTRACTOR AND PLATE REMOVER FOR RAIL MAINTENANCE

RELATED APPLICATIONS

This application is a continuation-in-part of Ser. No. 09/810,975, filed Mar. 16, 2001 now U.S. Pat. No. 6,463,858 entitled RAIL TIE REPLACEMENT METHOD AND APPARATUS and Ser. No. 10/113,585 filed Mar. 29, 2002 entitled PLATE HANDLING SYSTEM, both of which are incorporated herein by reference.

BACKGROUND OF THE INVENTION

This application relates generally to railway right-of-way maintenance equipment of the type used to repair and maintain railroad track. More specifically, the present invention relates to an apparatus for replacing rail ties and for handling rail tie plates during rail tie replacement.

Conventional railroad track consists of a plurality of spaced parallel wooden ties to which are each attached a pair of spaced rail tie plates. Each tie plate is configured to rest on the upper surface of the tie and includes holes for receiving spikes or screws, as well as a canted seat or a cradle formation for receiving the bottom of the steel rail. Since two rails make up a railroad track, there is a pair of spaced tie plates on each tie. Some of the spikes are used to secure the tie plate on the tie and others are used to secure the base of the rail to the tie plate cradle.

During track maintenance operations, it is common to periodically remove worn out or rotten ties. This is accomplished by first removing the spikes which hold the plates to the tie as well as to the rail. Railroad ties are typically removed and replaced using specially designed machines. Generally, the tie replacing machines roll along the railroad track and stop at a tie needing replacement. Most machines have an extending member that positions a gripping device normally relative to the track and adjacent to an end of a rail tie to remove it. The gripping device has vice-like jaws that clamp onto the end of the rail tie (other machines have a pushing mechanism which pushes the loosened tie transversely from the track). Then, the extending member extends normally away from the track, and thereby removes the tie from under the railroad track. The reverse operation is used to insert a new tie under the track.

Although these prior machines are able to remove and replace the railroad ties, the machines are subject to several disadvantages. One disadvantage is that the extending members on the prior machines are relatively unstable. On the prior machines, the extending members are attached to the railroad repair machine frame at the center of the members. In operation, each member has an inner portion that is slidingly engaged within an outer portion and telescopes away from the frame to position the gripping mechanism relative to the rail tie. The length of the fully extended member places stress at the attachment point where the end of the member meets the frame. This stress often causes the member to sag, work improperly or even break over time. Furthermore, some prior machines only had one extending member, which was attached to a pivot, in order to remove ties from the other side of a track if necessary. These machines experienced additional stress at the attachment point due to the excess movement and vibration on the extending member.

More recently developed machines include two extending members, one on each side of the machine that are mounted along the same axis. A main support member is situated in the middle of the machine frame and contains the two extending members which are slidingly engaged with each other. This innermost member extends in an opposite direction from the next outer member. In operation, one extending member slides outward within the main support member, and away from the machine frame, towards the location of the rail tie.

The dual in-line extending member design increases efficiency and overcomes the stress experienced by the single pivoting extending member design. These machines can remove a rail tie from either side of a track without pivoting, however stress problems still occur when the extending member is completely extended away from the frame. The full extension places most of the weight of the extending member on the minimal contact point between the extending member and the main support member. Stress is created on the contact point between the main support member and extending member, and failure results.

As the tie is extracted, the loosened tie plates either fall into the rail bed or ballast, or are retained on the removed tie. Conventional practice is to manually remove the plates and throw them off to the side of the ballast so that they do not interfere with the replacement of the new tie. Once the new tie is inserted under the raised track, the plates must be reinserted in the appropriate position to support the rail and for re-spiking.

To avoid on the job injuries, especially those involved with handling tie plates, which typically weigh approximately 18–40 pounds and are heavy to manipulate, railways have attempted to mechanize the tie replacement and plate placement process as much as possible. One attempt has been to provide a mechanism which grips the plates and secures them to the rail as the tie is removed from beneath the plates. This system has not been widely accepted by the railroads because of its relatively complicated mechanism, and because in many instances the insertion of the new tie will cause particles of railway ballast to be retained on top of the tie and interfere with the repositioning of the tie plates. These conventional mechanisms have no way to remove unwanted ballast particles from the top surface of the tie.

Another drawback of conventional mechanized plate placement devices is that their speed is relatively slow and they cannot keep up with the other operations of the rail maintenance gang. Using manual removal and placement of tie plates, the tie replacement process typically operates at a rate of about 15 ties per minute. Conventional mechanized plate removal devices operate in the range of 3 to 5 ties per minute. At this point, this rate of production is unacceptable to the railroads.

Thus, there is a need for improved rail maintenance machinery which addresses the above-listed drawbacks by synchronizing the operations of tie extraction and plate handling. In addition, there is a need for an improved tie plate handling apparatus which addresses the problem of tie plates getting in the way of the tie extraction process. Another need in the industry is an improved plate handling system which reduces the manual handling of plates during the tie replacement process.

BRIEF SUMMARY OF THE INVENTION

The above-listed goals are met or exceeded by the present combined tie extractor and plate remover, which features the ability to grasp tie plates independently of the tie extraction procedure. In this manner, the tie plates do not interfere with the extraction and/or subsequent insertion of ties. Also, the tie plate remover assembly is preferably movable relative to the main machine frame, which allows the removed tie plates to be released remotely from the location of the tie extraction. In addition, when two non-axially aligned tie gripping extending members are provided on the frame, the movable tie plate remover assembly may be selectively movable to reference points associated with each of the extending members for operation on either side of the frame or either rail.

More specifically, a combined tie extractor and plate remover for railroad track maintenance includes a frame configured for movement along the track and having a first side corresponding to a first side of the track and a second side corresponding to a second side of the track, each side of the track having a corresponding rail. A rail lifting apparatus associated with the frame is configured for lifting a selected one of the first and second rails away from the track. A plate remover assembly associated with the frame is configured for grasping and removing tie plates associated with each side of the track from a selected tie. At least one tie extracting assembly is disposed on the frame for extracting the gripped tie transversely relative to the track in conjunction with the removal of the tie plates.

In another embodiment, a method for extracting ties and removing plates from a railroad track having a first and a second rail, includes gripping both tie plates located upon a tie to be extracted using a tie plate gripping assembly, lifting one or both of the rails of the track at a selected location of a tie extraction, pulling the tie plates away from the tie, grasping an end of the tie to be extracted adjacent the location where the rail is lifted, the grasping being performed by a tie gripping and extraction assembly, pulling the grasped tie transversely relative to said track from the point where the rail was lifted, and releasing the gripped plates.

DETAILED DESCRIPTION OF THE INVENTION

Figure 1:
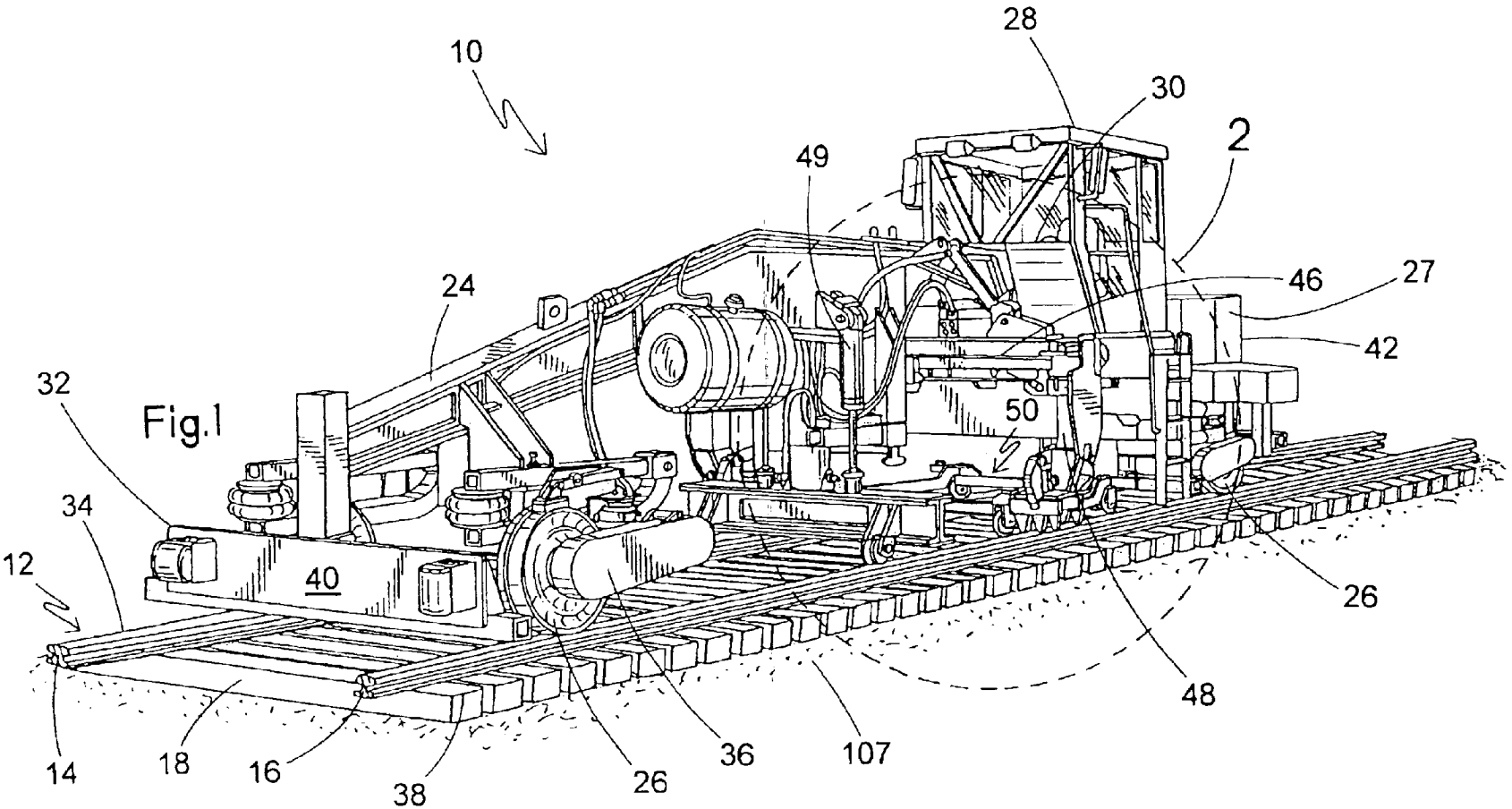
FIG. 1 is a front perspective view of a rail tie extraction apparatus incorporating the present plate removing assembly, shown fragmentary.

Referring now to FIG. 1, a rail tie extraction apparatus incorporating the present invention is generally designated 10 and is configured for movement (preferably, but not exclusively, self-propelled) along a railroad track 12. As is well known in the art, the track 12 includes first and second rails 14, 16 which are connected to ties 18 using tie plates 20 and spikes 22 (plates and spikes shown in FIG. 3). As is well known, the ties 18 are typically wood, but are also made of concrete in some applications. The present application is concerned with track laid upon wooden ties 18, which periodically need replacement due to natural deterioration.

Furthermore, the apparatus 10 includes a frame 24 supported on a plurality of wheels 26 so that the frame can be driven along the rails 14, 16. The frame 24 supports a source of motive power such as an internal combustion engine 27 which also powers a fluid power system used for operating the various rail maintenance equipment found on, or associated with, the frame 24. In the preferred apparatus 10, the fluid power system is hydraulic, however other fluid power systems are contemplated, but are less desirable. An operator's cab 28 is mounted to the frame 24 and includes a control system 30 (best seen in FIG. 6). As is known in the art, a main component of the control system 30 is a Programmable Logic Controller (PLC).

The frame 24 has a first side 32 corresponding to a first side 34 of the track 12 and associated with the rail 14, and a second side 36 corresponding to a second side 38 of the track and associated with the rail 16. In addition, the frame 24 has a first or front end 40 and a second or rear end 42. In the preferred embodiment, the operator's cab 28 is situated nearer to the rear end 42 of the apparatus 10 and enables the operator to observe and control repair operations on either rail 14 or 16. However, other locations for the cab 28 are contemplated. Also, an important feature of the present invention (seen schematically in FIG. 4) is that a first extending member 44 and a second extending member 46 are attached to the frame 24 in a non-axial relationship to each other, and each control the positioning of a corresponding gripping mechanism 48 relative to the plurality of the rail ties 18. In the preferred embodiment, the first and second extending members, 44, 46, are positioned directly adjacent to each other, but it is also contemplated that first and second extending members may be positioned in spaced apart orientation at other locations along the frame 24.

As is known on other such rail maintenance equipment, a rail lifting apparatus 49 is provided to lift a selected one of the rails 14, 16 in close proximity to the tie 18 selected for replacement. The particular rail 14, 16 which is lifted is the side of the track 12 from which the tie 18 will be extracted. It is this same side of the track 12 from which the spikes 22 were previously removed from the plates 20 by other equipment as is known in the art.

The extending members 44, 46 are configured to telescope longitudinally from the frame 24 such that when the gripping mechanism 48 engages the end of a selected tie 18, the telescoping movement pulls the tie transversely away from the track 12. An advantage of the present apparatus 10 is that a plate removing assembly, generally designated 50 is provided to automatically grasp and retrieve the previously de-spiked tie plates 20 in conjunction with the tie extraction. In the application, tie extraction is understood to mean either pulling of the ties using a gripping mechanism as described herein, or pushing the ties transversely relative to the track 12.

Figure 2:
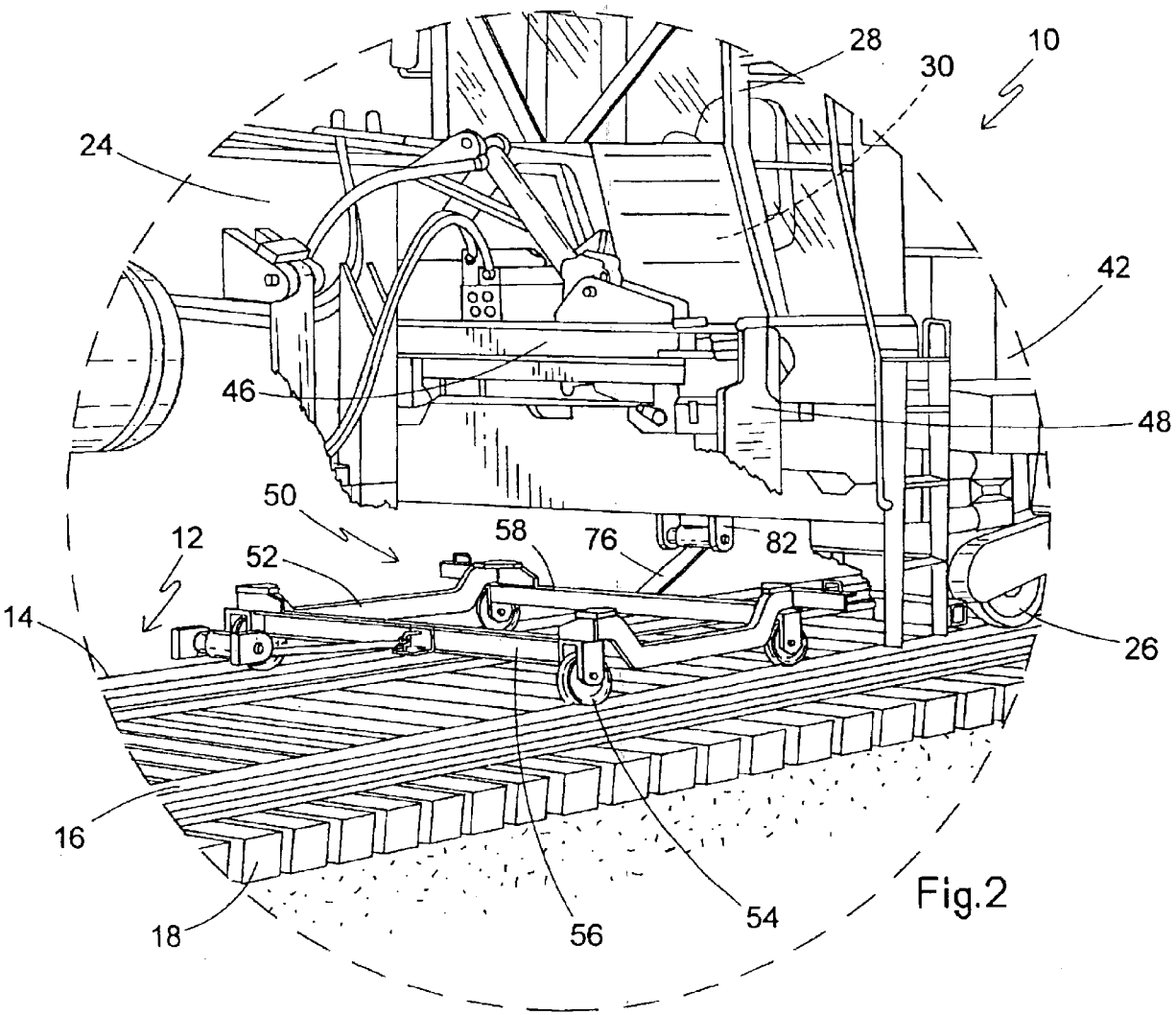
FIG. 2 is an enlarged fragmentary view of the apparatus of FIG. 1 showing the plate removing assembly with portions removed for clarity.
Figure 3:
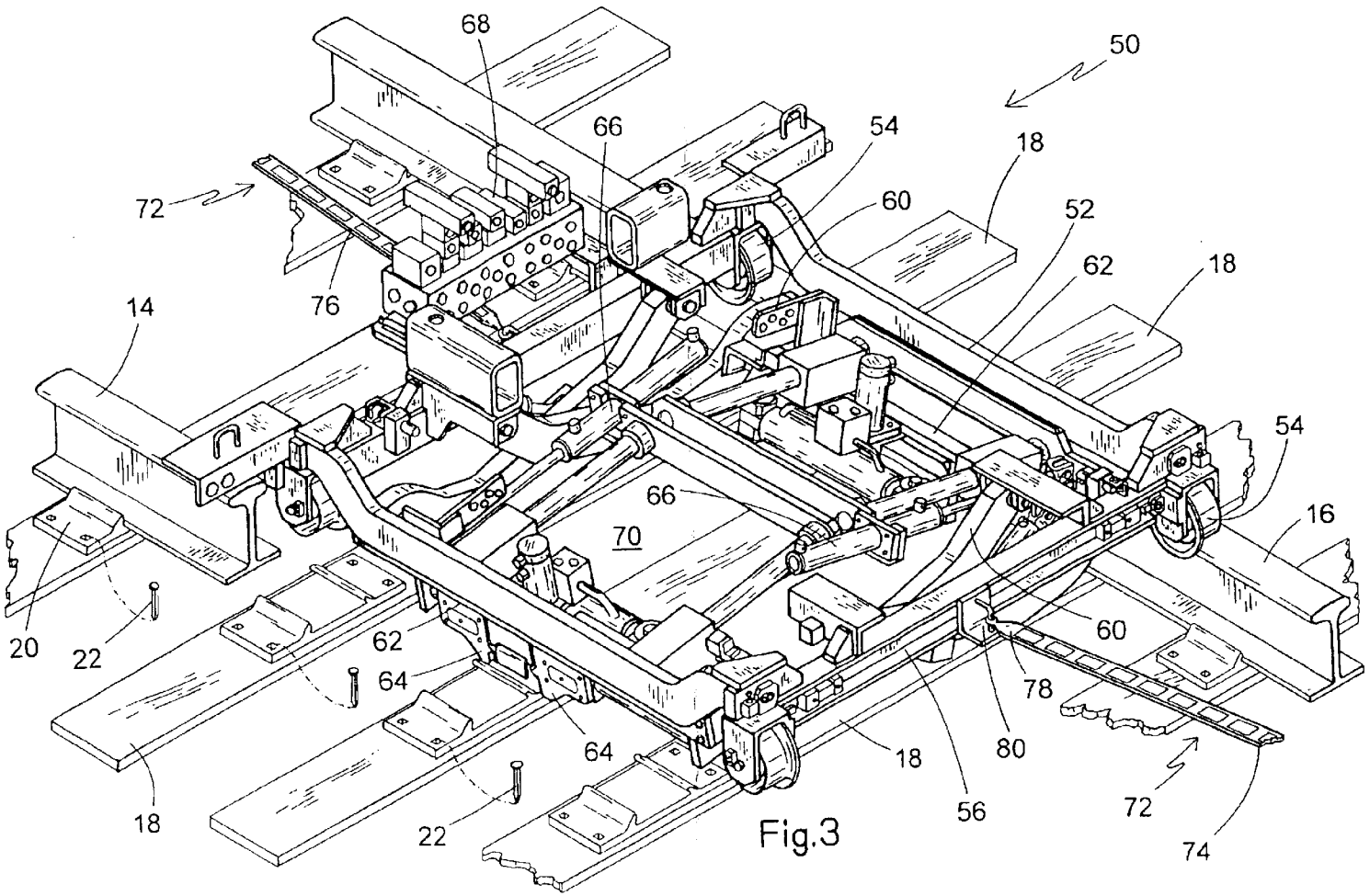
FIG. 3 is a top perspective view of the present plate removing assembly.

Referring now to FIGS. 2 and 3, the plate removing assembly 50 includes a remover frame or buggy 52 supported on rail wheels 54 for movement along the track 12 relative to the apparatus 10. A front end 56 of the remover frame 52 is associated with the front end 40 of the frame 24, and a rear end 58 of the remover frame is associated with the rear end 42 of the frame 24. The operational details of the plate remover assembly 50 are provided in commonly-assigned Ser. No. 10/113,585, filed Mar. 29, 2002, which is incorporated by reference. While the plate remover assembly 50 is preferred as described above, it is contemplated that the benefits of the present invention may be equally achieved by employing other conventionally known technology for grasping and handling plates, including, but not limited to magnetic apparatus, air suction devices, or other devices not employing mechanical gripping jaws as described above. It will be understood that "plate removing" encompasses all of these technologies.

Basically, the tie plate remover assembly 50 includes at least one and preferably two subframes 60, each with an associated plate gripping assembly 62, including opposing plate gripping jaws 64. The jaws 64 move reciprocally under fluid power control in the direction of the rails 14, 16. In addition, a retracting mechanism 66 is provided to pull the gripped tie plates 20 away from the tie 18. A subframe 60 including a plate gripping assembly 62 and opposing jaws 64 is provided for each rail 14, 16 so that both plates 20 located on a single tie 18 may be removed prior to the extraction of the tie from the track 12.

Upon operator actuation of the control system 30 which activates a plate gripping control system 68 (represented schematically by hydraulic manifolds), the gripping jaws 64 come together about the forward and rear edges of a selected tie plate 20 and grasp it under fluid power. Next, the retracting mechanism 66 moves the gripped plate away from the tie 18. Preferably, the gripped plate is moved to an area 70 between the rails 14, 16, however it is contemplated that the plate may be moved to another area away from the movement of the tie 18 as it is being extracted.

It is contemplated that the plate remover assembly 50 is connectable in a fixed position relative to the frame 24, using welded or otherwise fastened bracket members (not shown) connecting the respective components. However, in the preferred embodiment, the present tie extraction apparatus 10 includes a locating system, generally designated 72, which controls the movement of the plate remover assembly 50 relative to the frame 24. The system 72 preferably takes the form of a pair of retractable tethers 74, 76, each of which is connected at a hook end 78 to a respective eyelet 80 fixed to each of the front and rear ends 56, 58 of the remover frame 52. While the preferred tethers 74, 76 are belts or straps made of synthetic fabric selected for strength, durability and resistance to stretching, metal cables, chains or other such retractable tether materials are also contemplated.

Opposite the hook ends 78, each of the tethers 74, 76 is connected to a respective winch or powered winder 82 (best seen in FIG. 6 and designated 82F and 82R) affixed to the tie extractor apparatus 10, preferably on the frame 24. Energization of the winch 82 connected to the front tether 74 to retract the tether will pull the plate remover assembly 50 toward the front 40 of the frame 24, and energization of the winch 82 connected to the rear tether 76 to retract the tether will pull the assembly 50 toward the rear end 42 of the frame 24. Upon the energization of one of the winches 82, the control system 30 is configured to exert a braking force on the plate remover assembly 50 to steady its movement relative to the frame 24.

An important function of the locating system 72 is the positioning of the plate remover assembly 50 at a designated location relative to the frame 24, and specifically relative to the first and second extending members 44, 46. Proper alignment of the plate remover assembly 50 is important so that the plates 20 of a designated tie 18 can be removed in conjunction with the tie extraction. Thus, the locating system 72 is configured for determining the location of the plate remover assembly 50 relative to a reference point corresponding to the tie gripping mechanism 48 and for moving the plate remover assembly to the reference point.

Figure 4:
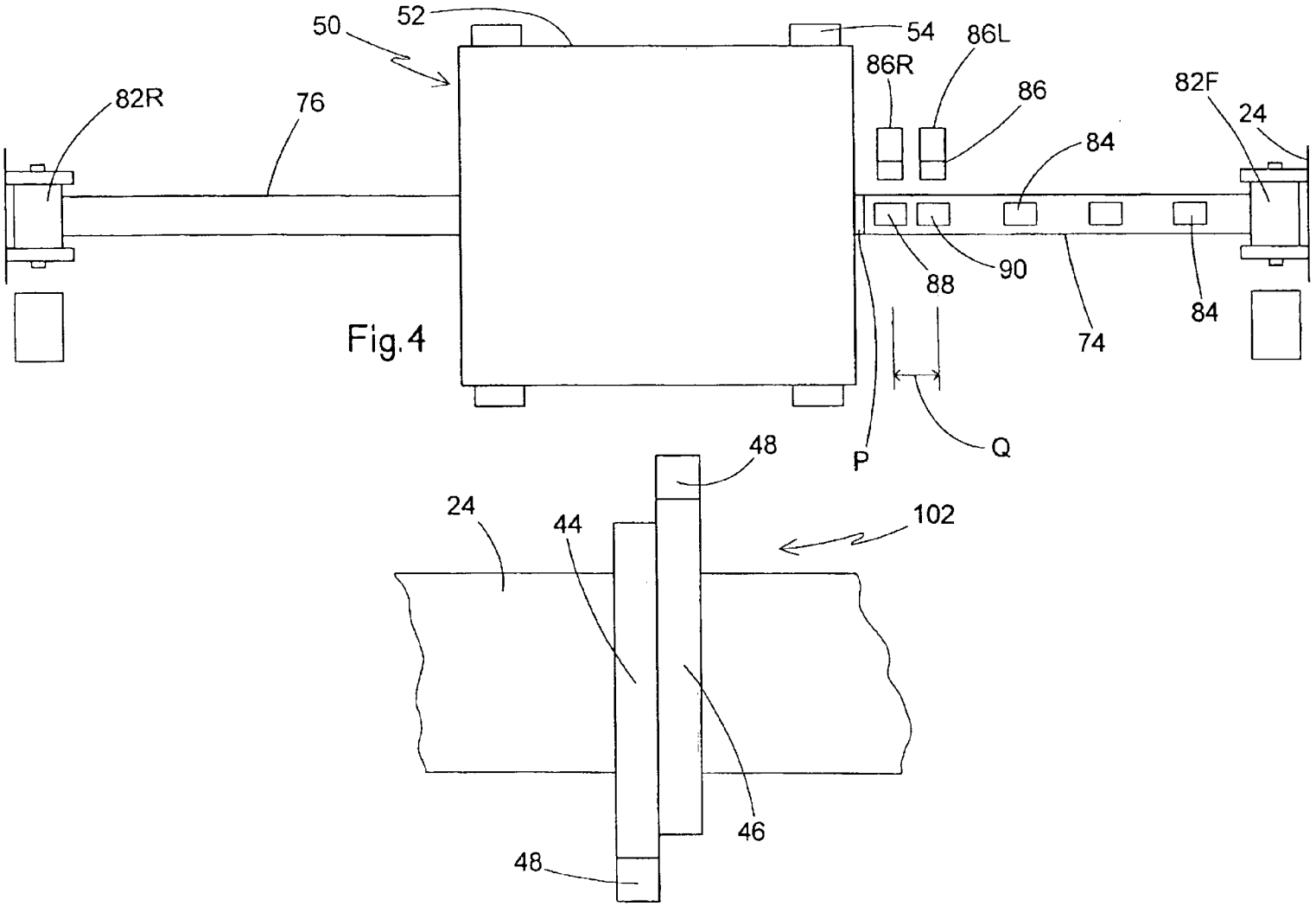
FIG. 4 is a schematic plan view of the present plate removing assembly connected to the present rail tie extraction apparatus when working on a first side of the track.
Figure 5:
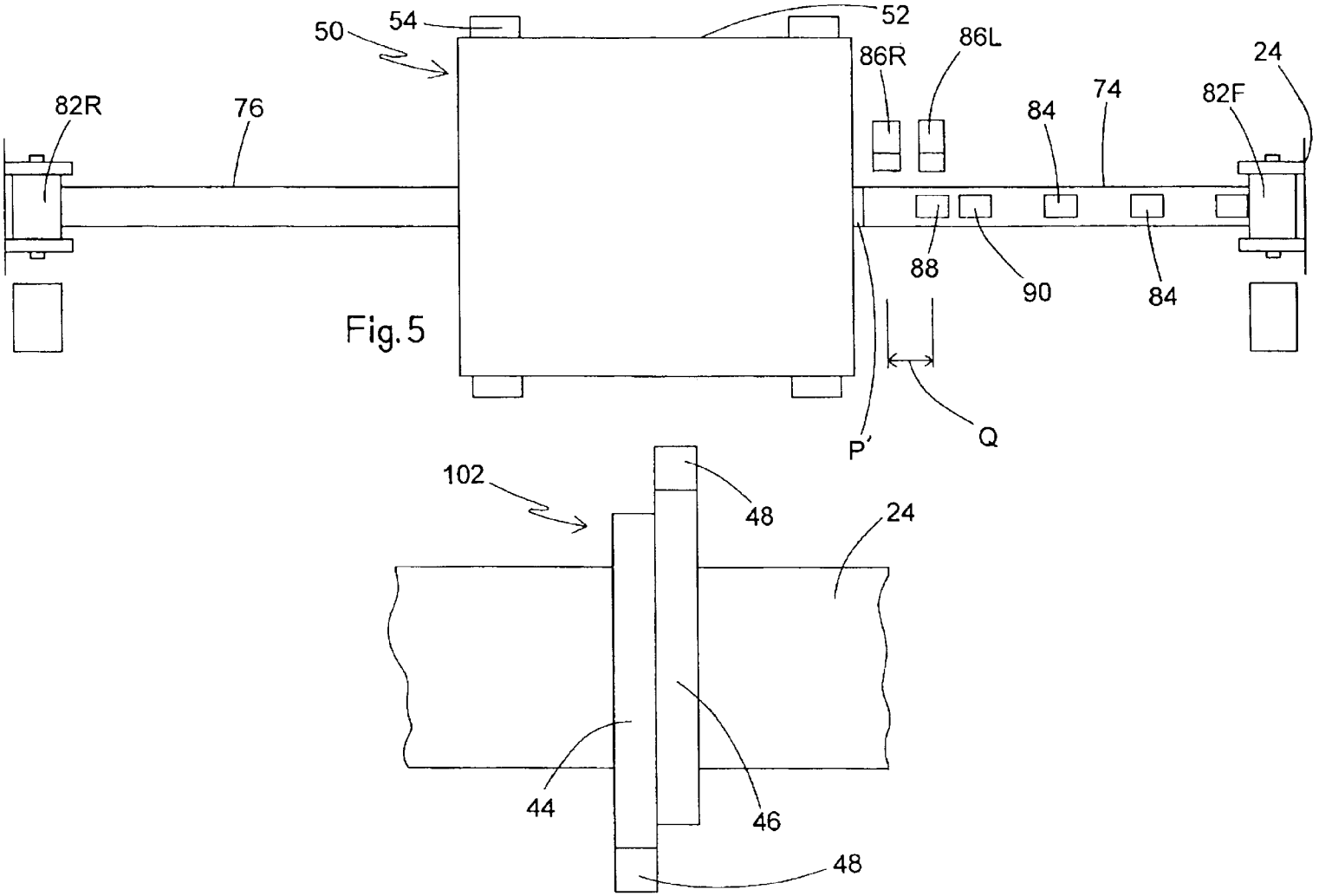
FIG. 5 is a schematic plan view of the present plate removing assembly connected to the present rail tie extraction apparatus when working on a second side of the track.

Referring now to FIGS. 4 and 5, to achieve this location objective, in the preferred embodiment, at least one of the tethers 74, 76 is provided with at least two linearly spaced indicators 84. The exact nature and/or composition of the indicators 84 may vary widely to suit the application, but in function the indicators must be capable of being sensed by at least one sensor unit 86. In the preferred embodiment, the sensor unit 86 is a proximity switch and the indicators 84 are metallic plates. Since the plates 84 are secured to a nonconductive tether material, the location of the plates on the tether 74, 76 provides the control system 30 with an indication of the position of the plate remover assembly 50 relative to the tie extraction apparatus 10. The control system 30 is configured to receive signals from the sensor unit 86 and to perform a counting function to determine how many indicator plates 84, correspondingly how much of the tether length, and ultimately how much the assembly 50, has moved relative to the extraction apparatus 10.

To effect accurate positioning of the remover assembly 50, the sensor unit 86 is connected through the control system 30 to at least one and preferably both of the winches 82 to retract or extend the respective tethers 74, 76 as is necessary to properly locate the plate remover assembly. Further, the indicator plates 84 are placed on the tether 74 at a designated spacing which may vary to suit the application, but in the preferred embodiment is 18 inches. In addition, a pair of remover indicators 88, 90 are provided on the front tether 74 in a location closest to the front 56 of the remover frame 52. The remover indicators 88, 90 are preferably of the same construction of the indicators 84, but are spaced differently. Specifically, the remover indicators 88, 90 are spaced apart a distance "Q" which corresponds to the spacing of the respective tie extractor extending members 44, 46. Further, a pair of sensor units 86 are preferably provided, designated 86R and 86L, corresponding to the side (right or left) of the frame 24 at which the tie extraction operation will take place.

Since the extending members 44, 46 are mounted to the frame 24 in side-by-side relationship to each other, the orientation, or the respective reference point P, of the remover frame 52 for plate gripping and removal will be different depending on which of the extending members 44, 46 is in use. Referring now to FIG. 4, when the extending member 44 is operating (on the left side of the track 12) once both sensor units 86R, 86L are triggered by the corresponding indicator plates 88, 90, the control system PLC will recognize that the remover frame 52 has reached the appropriate point P. Thus, the control system 30 will cause the remover frame 52 to move forward until the sensors 86R, 86L encounter the remover indicators 88, 90, designating that the proper position for removing the tie plates 20 from the tie has been achieved.

Referring now to FIG. 5, when the extending member 46 is operating (on the right side of the track 12), only the sensor 86L will be triggered by the remover indicator 88 after the control system 30 has moved the remover frame 52 to the adjusted reference point P'. If desired, the sensors 86L, 86R may be programmed to be triggered by the indicator 90. The relative displacement of the sensors 86L, 86R reflects the difference in the operational reference point P of the remover frame 52 associated with each of the extending members 44, 46.

Figure 6:
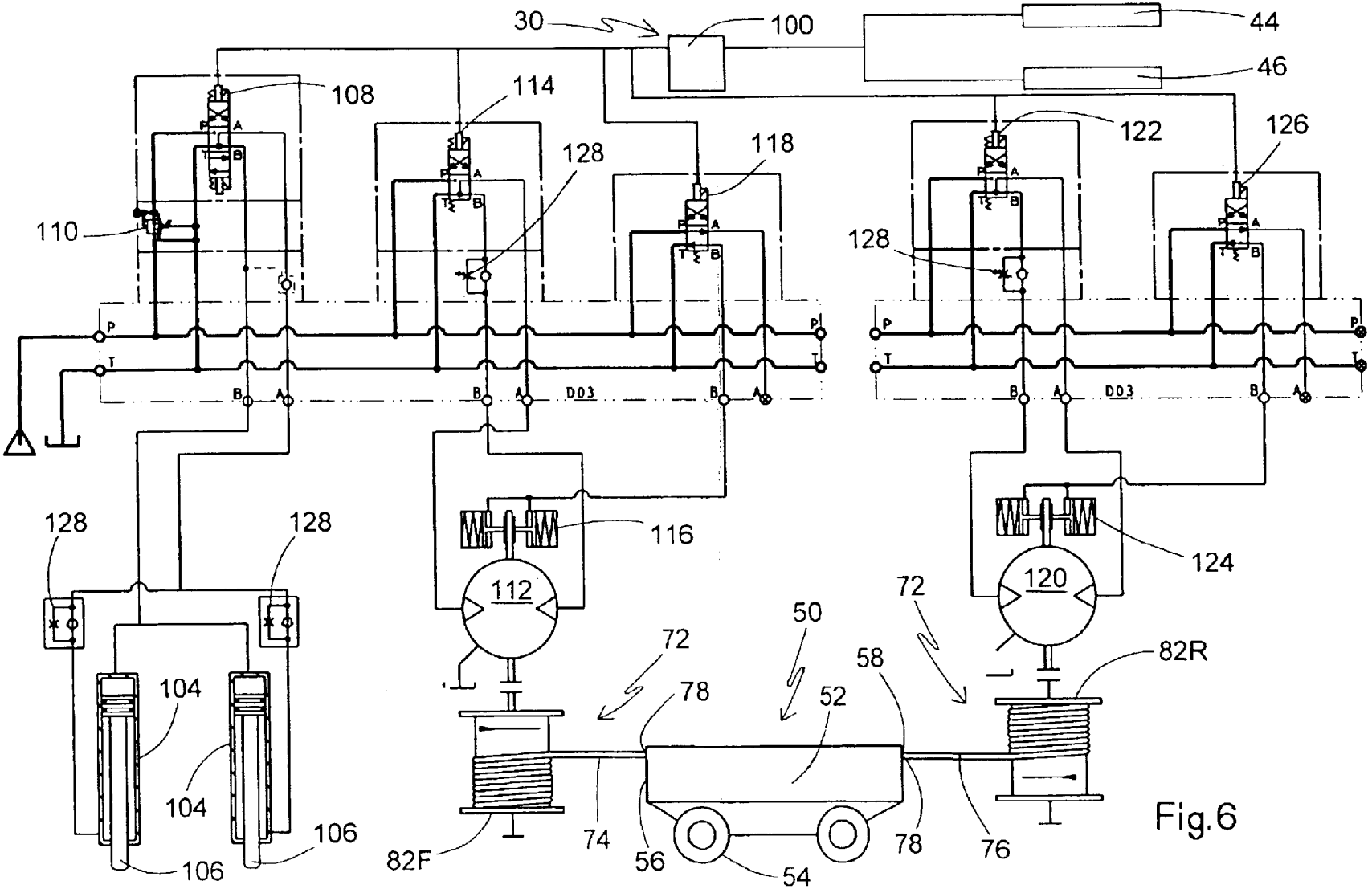
FIG. 6 is a hydraulic schematic of the present control system for the plate removing assembly.

Referring now to FIG. 6, the control system 30 is configured for operating the tie gripping and extraction apparatus 44, 46 and 48, as well as the plate remover assembly 50, and is schematically shown. As will be appreciated by those skilled in the art, as is typical with rail maintenance equipment, the majority of the functions described herein are actuated by fluid power systems, and preferably hydraulic fluid power. It is contemplated that the ordinary skilled practitioner will have sufficient knowledge to implement the functions described herein, which are achieved using commercially available hydraulic components. As such, the underlying hydraulic and, where applicable, related electronic circuitry have not been described in detail.

The control system 30 includes a main control panel 100 located in the cab 28. Both the tie gripping and pulling mechanism 44, 46, 48 (collectively referred to as 102 and the plate removing assembly 50 are connected to the control panel so that the respective functions can be coordinated. From a functional standpoint, it is important to the present invention that the tie gripping and extraction assembly 102 is activated upon the grasping of the tie plates 20 by the plate remover assembly 50. To increase the efficiency of the rail maintenance operation, it is important to prevent the tie plates from being dragged from the rail bed along with the extracted tie 18. Thus, the rail tie extraction apparatus 10 is constructed, and the control system 30 is configured to sequentially operate the components 50, 102 so that once the plates 20 are grasped and displaced from the ties, the operator then manually initiates the ties being pulled from the track 12.

In addition, as described above, the control system 30 is configured to locate the remover frame 52 relative to the first and second extending members 44, 46 so that the plates 20 are automatically removed from the correct selected tie 18. The particular selected extending member 44, 46 is relevant to the side of the track 12 from which the tie 18 is being extracted.

In the event the remover frame 52 is movable relative to the frame 24, the remover frame 52 is provided with a pair of hold down cylinders 104 which temporarily stabilize the buggy relative to the track 12 by extending a piston rod 106 onto the plate remover frame to keep it on the rail 16. A buggy hold down valve 108 is connected to the control panel 100 and to both cylinders 104 for controlling their operation upon commencement of a tie replacement. As is known in the art, it is preferable to include a pressure relief valve 110 in the circuit including the hold down valve 108, and in this application the valve 110 is set at 550 psi. The precise setting may vary to suit the application.

To bring the remover frame or buggy 52 forward toward the sensor units 86, the winch 82F located nearer the front end 40 of the frame 24 is activated. In the preferred embodiment, the winches 82 are hydraulically powered by a hydraulic motor 112 under the control of a forward control valve 114, which in turn is under the control of the control panel 100. Since the movement of the remover frame 52 must be precisely controlled, the winch motor 112 is also equipped with a brake 116 to prevent unwanted rotation of the motor, and ultimately, the winch 82F. A winch brake valve 118 applies the brake 116 when directed to by the control panel 100, usually upon the desired disposition of the remover frame 52, as triggered by the sensor unit 86.

As a further control on the movement of the remover frame 52, to both hold the frame in place by pressure on the rear tether 76, and also to move the frame in the reverse direction, the control system 30 generates a reverse biasing force in the form of a separate reverse motor 120 operated by a motor control valve 122 for powering the second winch 82R. In similar fashion to the forward motor 112, a reverse winch brake 124 is provided for stopping unwanted rotation of the motor 120 and the winch 82R. A rear winch brake valve 126 controls the reverse winch brake 124 and is under the control of the control panel 100. To move the remover frame forward, or to the left in FIG. 6, the winch 82F is energized, which, when turned by the motor 112 pulls on the tether 74. At the same time, the tether 76 unwinds, which causes the motor 120 to rotate. However, a flow control valve 128 controls the flow of hydraulic fluid to the motor 120 and exerts a resistance force upon the motor, in effect braking the motor so that the winch 82R does not excessively unwind the tether 76. Since there is no energizing flow of fluid to the motor 120, the flow control 128 is configured to naturally create back pressure on 120 and that keeps the tether 76 taught. Thus, the flow control 128 meters flow out of the motor 120 without actually turning the motor on.

As necessary, the reverse winch brake 124 is applied to prevent excessive unwinding of the tether 76 from the rear winch 82R. The process is reversed when the buggy 52 needs to be moved closer to the rear end 42 of the frame 24. In that situation, the reverse winch 82R and its associated motor 120 provides the main motive force, and the appropriate flow control 128 provides the biasing control force.

Also, it is preferred that flow control valves 128 are provided for the circuits pressurizing the winch motors 112, 120 as well as the hold down cylinders 104. Also, signal connections 130 between the control panel 100 and the valves 108, 114, 118, 122 and 126 are shown schematically and it is contemplated that the valves may be controlled electronically, hydraulically, individually or in prescribed sequences, depending on the application, as is known in the art. A feature of the present invention is that the plates 20 are released by the gripping jaws 64 of the plate removing assembly 50 as soon as the tie 18 is fully retracted from the track 12.

In operation, it will be seen that the tie pulling apparatus 10 equipped with the plate removing assembly 50 extracts a tie 18 by first being located at a tie to be removed. The plate removing assembly 50 is then moved toward the selected tie 18 by the control assembly 30, and the remover frame 52 is accurately located through the operation of the indicators 84 and the sensor units 86R, 86L. The tie plates 20 on the selected tie 18 are engaged by the gripping jaws 64. Next, the rail lifting apparatus 49 is employed to lift either one or both of the rails 14, 16 on the side of the track from which the tie 18 will be removed. The plates 20 are then detached from the tie and moved away from the tie. As the tie plates 20 are being removed, the extending member 44, 46 and its associated gripping mechanism 48 grip an end of the tie 18 and pull it transversely from the track 12. As the tie 18 is pulled away, the plates 20 are released by the gripping jaws 64 and fall to the track between the rails 14, 16, or wherever designated.

While specific embodiments of the combined tie extractor and plate remover for rail maintenance of the present invention have been shown and described, it will be appreciated by those skilled in the art that changes and modifications may be made thereto without departing from the invention in its broader aspects and as set forth in the following claims.

What is claimed is:

1. A combined tie extractor and plate remover for maintenance on a railroad track, comprising:

a frame configured for movement along the track and having a first side corresponding to a first side of the track and a second side corresponding to a second side of the track, each side of the track having a corresponding rail;

a rail lifting apparatus associated with said frame and configured for lifting a selected one of the first and second rails away from the track;

a plate remover assembly associated with said frame and configured for grasping and removing tie plates associated with each side of the track from a selected tie; and at least one tie extracting assembly disposed on said frame for extracting the tie transversely relative to the track in conjunction with the removal of the tie plates;

wherein said plate remover assembly is movable on the track relative to said frame in a direction parallel to the track.

2. The apparatus of claim 1 further including a control mechanism connected to said plate remover assembly and said at least one tie extracting assembly for activating said at least one tie extracting assembly upon the grasping of the tie plates by said plate remover assembly.

3. The apparatus of claim 1 wherein said at least one extracting assembly further includes gripping means disposed on each of said sides of said frame and configured for grasping rail ties located in the track and extending means attached to said frame, said extending means including a first extending member associated with the first side of the track and a second extending member associated with the second side of the track, said extending members mounted to said frame in a non-axial relationship to each other and configured for positioning said gripping means relative to a selected rail tie located on the corresponding side of the track.

4. A combined tie extractor and plate remover for maintenance on a railroad track, comprising:

a frame configured for movement along the track and having a first side corresponding to a first side of the track and a second side corresponding to a second side of the track, each side of the track having a corresponding rail;

a rail lifting apparatus associated with said frame and configured for lifting a selected one of the first and second rails away from the track;

a plate remover assembly associated with said frame and configured for grasping and removing tie plates associated with each side of the track from a selected tie;

at least one tie extracting assembly disposed on said frame for extracting the tie transversely relative to the track in conjunction with the removal of the tie plates; and a locating system for locating said plate remover assembly at the selected tie;

wherein said plate remover assembly is movable on the track relative to said frame.

5. The apparatus of claim 4 wherein said locating system is configured for determining the location of said plate remover assembly relative to a reference point corresponding to said at least one extraction assembly, and moves said plate remover to said reference point.

6. The apparatus of claim 5 wherein said locating system includes a tether connecting said plate remover assembly to said frame, a plurality of linearly spaced indicators on said tether, a sensing mechanism for sensing said indicators and generating a location signal of said plate remover assembly which triggers a tether controller for adjusting the length of said tether and accordingly adjusts the position of said plate remover assembly.

7. The apparatus of claim 6 wherein said tether is taken from the group comprising belts, straps, cables and chains.

8. The apparatus of claim 6 wherein said sensing mechanism is configured for determining the distance of said plate remover assembly from said reference point, and for controlling said tether controller for adjusting the position of said plate remover assembly relative to said reference point.

9. The apparatus of claim 8 wherein said at least one tie extracting assembly further includes gripping means disposed on each of said sides of said frame and configured for grasping rail ties located in the track and extending means attached to said frame, said extending means including a first extending member associated with the first side of the track and a second extending member associated with the second side of the track, said extending members mounted to said frame in a non-axial relationship to each other and configured for positioning said gripping means relative to a selected rail tie located on the corresponding side of the track, wherein said sensing mechanism includes first and second proximity switches for establishing said reference point for each of said first and second extending members.

10. The apparatus of claim 6 wherein said tether controller further includes at least one motor for retracting and extending said tether, and a biasing mechanism for exerting a biasing force counter to said at least one motor.

11. A combined tie extractor and plate remover for maintenance of a railroad track, comprising:

a frame configured for movement along the track and having a first side corresponding to a first side of the track and a second side corresponding to a second side of the track, each side of the track having a corresponding rail;

a rail lifting apparatus associated with said frame for lifting a selected one of the first and second rails away from the track;

a plate remover assembly associated with said frame and configured for grasping and removing tie plates associated with each side of the track from a selected tie;

a pair of non-axially aligned extending members, each associated with a respective one of said sides of said frame and each being provided with a corresponding gripping and extracting assembly configured for extracting one of the ties of the track adjacent the lifted rail transversely relative to the track once the tie plates have been removed; and a locating system configured for moving said plate remover assembly relative to said extending members, said system having a sensing system configured for creating a first operational reference point for locating said plate remover assembly adjacent a first one of said extending members, and a second operational reference point for locating said plate remover assembly adjacent a second one of said extending members.

12. The apparatus of claim 11 further including a control system configured for selectively activating one of said first and second extending members so that said first extending member pulls ties from a right side of said frame, and said second extending member pulls ties from a left side of said frame, said sensing system includes a first sensor for determining the position of said plate remover assembly relative to said first extending member, and a second sensor for determining the position of said plate remover assembly relative to said second extending member.

13. The apparatus of claim 12 wherein said locating system includes a tether connecting said plate remover assembly to said frame and having a plurality of linearly spaced indicators, and said first and second sensors are configured for determining the position of said plate remover assembly relative to said reference point.

14. The apparatus of claim 13 further including a tether controller having at least one motor for retracting and extending said tether, and a biasing mechanism for exerting a biasing force counter to said at least one motor.

15. The apparatus of claim 13 wherein said tie plate gripping assembly is configured for grasping a selected tie plate, pulling the plate away from the rail and away from the tie, and subsequently releasing the plate.

16. The apparatus of claim 15 wherein said sensing system is configured for controlling said tie plate gripping assembly regarding the location of where the tie plates are released.

17. A method for extracting ties and removing plates from a railroad track having a first and a second rail, comprising:

gripping a front edge and a rear edge of both tie plates located upon a tie to be extracted using a tie plate gripping assembly;

lifting at least one of the rails of the track at a selected location of a tie extraction;

pulling the tie plates away from the tie;

grasping an end of the tie to be extracted adjacent the location where the rail is lifted, said grasping being performed by a tie gripping and extraction assembly;

pulling the grasped tie transversely relative to said track from the point where the rail was lifted; and releasing said gripped plates.

18. The method of claim 17 wherein said plates are released upon the pulling of the grasped tie away from the track.

19. A method for extracting ties and removing plates from a railroad track having a first and a second rail, comprising:

gripping both tie plates located upon a tie to be extracted using a tie plate gripping assembly;

lifting at least one of the rails of the track at a selected location of a tie extraction;

pulling the tie plates away from the tie;

grasping an end of the tie to be extracted adjacent the location where the rail is lifted, said grasping being performed by a tie gripping and extraction assembly;

pulling the grasped tie transversely relative to said track from the point where the rail was lifted; and releasing said gripped plates;

wherein said tie plate gripping assembly is movable along said track relative to said tie gripping and extraction assembly, and said method includes locating said plate gripping assembly adjacent said tie gripping and extraction assembly after said rail lifting step.

20. The method of claim 19 wherein said tie gripping and extraction assembly includes two non-axial extending members, one associated which each rail of the track, said location of said plate gripping assembly further includes locating said assembly to a first location for operation on a side of the track associated with the first rail, and locating said assembly to a second location for operation on a side of the track associated with the second rail.

* * * * *